US007415846B2

(12) United States Patent
Park

(10) Patent No.: US 7,415,846 B2
(45) Date of Patent: Aug. 26, 2008

(54) BUTTON ASSEMBLY AND WASHING MACHINE HAVING THE SAME

(75) Inventor: Jong A Park, Chanwon-si (KR)

(73) Assignee: LG. Electronics Inc., Seoul (KR)

( * ) Notice: Subject to any disclaimer, the term of this patent is extended or adjusted under 35 U.S.C. 154(b) by 561 days.

(21) Appl. No.: 10/892,100

(22) Filed: Jul. 16, 2004

(65) Prior Publication Data

US 2005/0193778 A1 Sep. 8, 2005

(30) Foreign Application Priority Data

Mar. 2, 2004 (KR) ..... 10-2004-0014005

(51) Int. Cl.
*B08B 3/12* (2006.01)

(52) U.S. Cl. ..... 68/3 R; 68/12.01; 68/12.27; 200/5 R; 200/18

(58) Field of Classification Search ..... 200/5 R, 200/18; 68/3 R, 12.01, 12.27
See application file for complete search history.

(56) References Cited

U.S. PATENT DOCUMENTS 5,710,318 A * 1/1998 Cirjak et al. ..... 560/245
5,739,486 A * 4/1998 Buckingham ..... 200/5 A
5,788,060 A * 8/1998 Kuroda ..... 200/343
6,018,131 A * 1/2000 Snider ..... 200/301
6,914,206 B2 * 7/2005 Mukougawa ..... 200/556
6,960,734 B1 * 11/2005 Park ..... 200/343
7,135,650 B2 * 11/2006 Jung ..... 200/314

FOREIGN PATENT DOCUMENTS

JP 2002093282 * 3/2002

* cited by examiner

*Primary Examiner*—Michael Barr
*Assistant Examiner*—Jason Heckert
(74) *Attorney, Agent, or Firm*—McKenna, Long & Aldridge LLP

(57) ABSTRACT

A button assembly and a washing machine having the same, by which a simplified structure enabling to perform assembly and disassembly of the button assembly are disclosed. The button assembly includes a panel having at least one button hole, at least one push button inserted in the at least one button hole in part, and an elastic part coupled to the panel to prevent the at least one push button from being separated from the panel and to elastically support a rear side of the at least one push button.

19 Claims, 5 Drawing Sheets

BUTTON ASSEMBLY AND WASHING MACHINE HAVING THE SAME

This application claims the benefit of Korean Application No. P2004-014005, filed on Mar. 2, 2004, which is hereby incorporated by reference.

BACKGROUND OF THE INVENTION

1. Field of the Invention

The present invention relates to a washing machine, and more particularly, to a button assembly and washing machine having the same, by which assembly and disassembly of the button assembly are facilitated.

2. Discussion of the Related Art

Generally, in a washing machine, a tub contains water and detergent inside and a laundry is put in a drum installed within the tub. And the drum is rotated to perform washing, rinsing, and dewatering. The washing machine is an apparatus for removing filth or dirt attached to the laundry using the detergent and mechanical energy applied thereto appropriately.

Specifically, a drum, which is horizontally installed within a drum type washing machine, contains detergent, water, and laundry therein and is then rotated by a drive force of a motor to remove filth or dirt attached the laundry. Such a drum type washing machine avoids causing damage or ravel to the laundry, consumes less water, and brings about a washing effect of beating and rubbing.

A general drum type washing machine consists of a cabinet forming an overall exterior, an opening formed at a front side of the cabinet for putting/pulling a laundry in/from the washing machine, a door provided to the front side of the cabinet to open/close the opening, a tub provided within the cabinet to contain water therein, a drum rotatably installed within the cabinet to perform washing on the laundry therein, a multitude of perforated holes formed at a wall of the drum so that the water passes through the perforated holes, an inlet pipe for supplying the water within the cabinet, and an outlet pipe for discharging the water outside the cabinet.

A control panel is provided to an upper front side of the cabinet to control an operation of the washing machine. And, a button assembly for inputting an operational condition of the washing machine and a display unit for displaying an operational state of the washing machine are provided to the control panel. The control panel including the button assembly 20 according to a related art is explained in detail by referring to FIG. 1.

First of all, a plurality of push switches 31, a plurality of light-emitting diodes 32, an integrated circuit (not shown), and a circuit board 30 having segments and the like mounted thereon are provided inside a control panel 10. And, a button assembly 20 consists of a plurality of push buttons 21 pushing the push switches 31, respectively, a panel 22 covering a front side of the circuit board 30 and having the push buttons 21 provided thereto, and a plurality of plate springs 23 elastically supporting the push buttons 21 in a direction opposite to a push direction, respectively.

And, a plurality of button holes 22*a* are formed on the panel 22, whereby the push buttons 21 are inserted in the button holes 22*a*, respectively. Moreover, a display unit (not shown) displaying an operational state of the washing machine is provided next to one side of the button assembly 20.

When a specific one of the push buttons 21 is pressed from a front side of the control panel 10, the pressed push button 21 overcomes an elastic force of the plate spring 23 to press the corresponding push switch 31. Hence, a specific operational condition of the washing machine is inputted to operate the washing machine, accordingly. Meanwhile, if an external force pressing the push button 21 is released, a restoring force of the plate spring 23 makes the push button 21 return to its original position.

However, in the related art button assembly, the push button 21 is hooked on the panel 22 to enable a push behavior and the plate spring 23 is locked to an inside of the panel 22 by a screw, whereby the assembly and disassembly of the button assembly 20 are complicated to reduce work efficiency thereof.

SUMMARY OF THE INVENTION

Accordingly, the present invention is directed to a button assembly and washing machine having the same that substantially obviate one or more of the problems due to limitations and disadvantages of the related art.

An object of the present invention is to provide a button assembly and washing machine having the same, by which a simplified structure enabling to perform assembly and disassembly of the button assembly is provided.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, a button assembly includes a panel having at least one button hole, at least one push button inserted in the at least one button hole in part, and an elastic part coupled to the panel to prevent the at least one push button from being separated from the panel and to elastically support a rear side of the at least one push button.

Preferably, one end of the at least one push button is rotatably provided between the panel and the elastic part. Herein, the push button includes a button body inserted in the button hole, a flange provided to a rear edge portion of the button body to limit a forward motion of the button body by being caught on a rim of the button hole, and a hinge shaft provided to one end of the flange, the hinge shaft being rotatably provided between the panel and the elastic part.

The hinge shaft is provided between and is supported by a first semicircular hinge recess provided to the panel and a second semicircular hinge recess provided to the elastic part. The hinge shaft is extended in both lateral directions of the flange such that both end portions of the hinge shaft are not connected to each other.

A coupling protrusion is protruded from a rear side of the panel, and a coupling hole is provided to the elastic part to have the coupling protrusion inserted therein. Herein, the coupling protrusion is provided between both end portions of the hinge shaft, and a recess is provided to the flange such that a motion of the flange does not interrupt with the coupling protrusion. A hinge coupling part is provided to one side of the flange to couple with the hinge shaft.

The elastic part includes at least one plate spring supporting a rear side of the at least one push button, and a spring fixing part coupled to the panel, wherein the at least one plate spring is rigidly fixed to the spring fixing part as a single body. And, a plurality of the plate springs is fixed to the spring fixing part as a single body.

In another aspect of the present invention, a washing machine includes a cabinet forming an exterior of the washing machine, a tub provided within the cabinet to contain water therein, a drum rotatably provided within the tub to perform laundry washing therein, a control panel provided to one side of the cabinet, and a button assembly provided to the control panel to input operational commands of the washing machine, wherein the button assembly includes a panel having at least one button hole, at least one push button inserted in the at least one button hole in part, and an elastic part, wherein the elastic part includes a spring fixing part coupled to the panel to rotatably support the at least one push button together with the panel and to prevent the at least one push button from being separated from the panel, and at least one plate spring rigidly fixed to the spring fixing part as a single body to elastically support a rear side of the at least one push button.

The push button includes a button body inserted in the button hole, a flange provided to a rear edge portion of the button body to limit a forward motion of the button body by being caught on a rim of the button hole, and a hinge shaft provided to one end of the flange, the hinge shaft being rotatably provided between the panel and the elastic part.

The hinge shaft is extended in both lateral directions of the flange such that both end portions of the hinge shaft are not connected to each other. The hinge shaft is provided between and is supported by a first semicircular hinge recess provided to the panel and a second semicircular hinge recess provided to the elastic part.

Preferably, a coupling protrusion is protruded from a rear side of the panel, and a coupling hole is provided to the spring fixing part of the elastic part to have the coupling protrusion inserted therein. Herein, the coupling protrusion is provided between both end portions of the hinge shaft, and a recess is provided to the flange such that a motion of the flange does not interrupt with the coupling protrusion. And, the coupling protrusion is fastened to the elastic part by one or more screws.

Preferably, the flange includes a hinge coupling part that couples with the hinge shaft. And, a plurality of the plate springs is fixed to the spring fixing part as a single body.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings. Throughout the drawings, like elements are indicated using the same or similar reference designations where possible.

Figure 1:
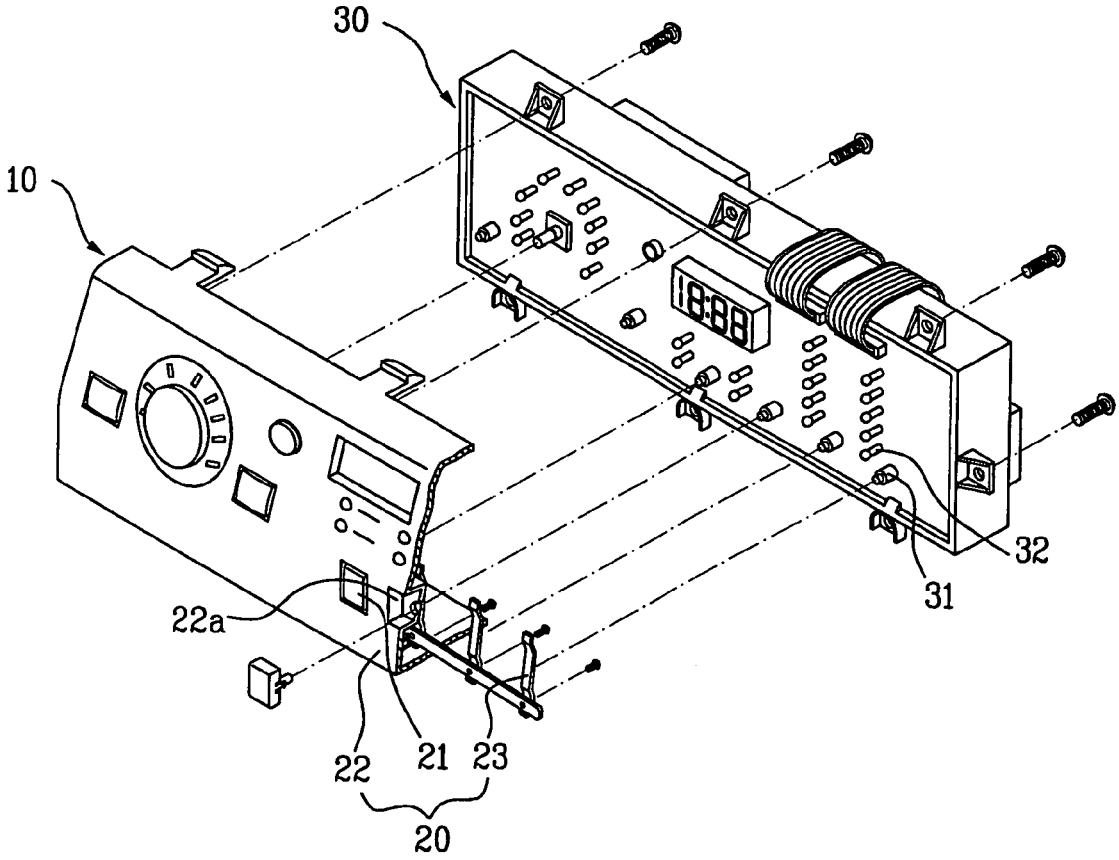
FIG. 1 Prior Art
FIG. 1 is a projected perspective diagram of a control panel having a button assembly provided thereto according to a related art.
Figure 2:
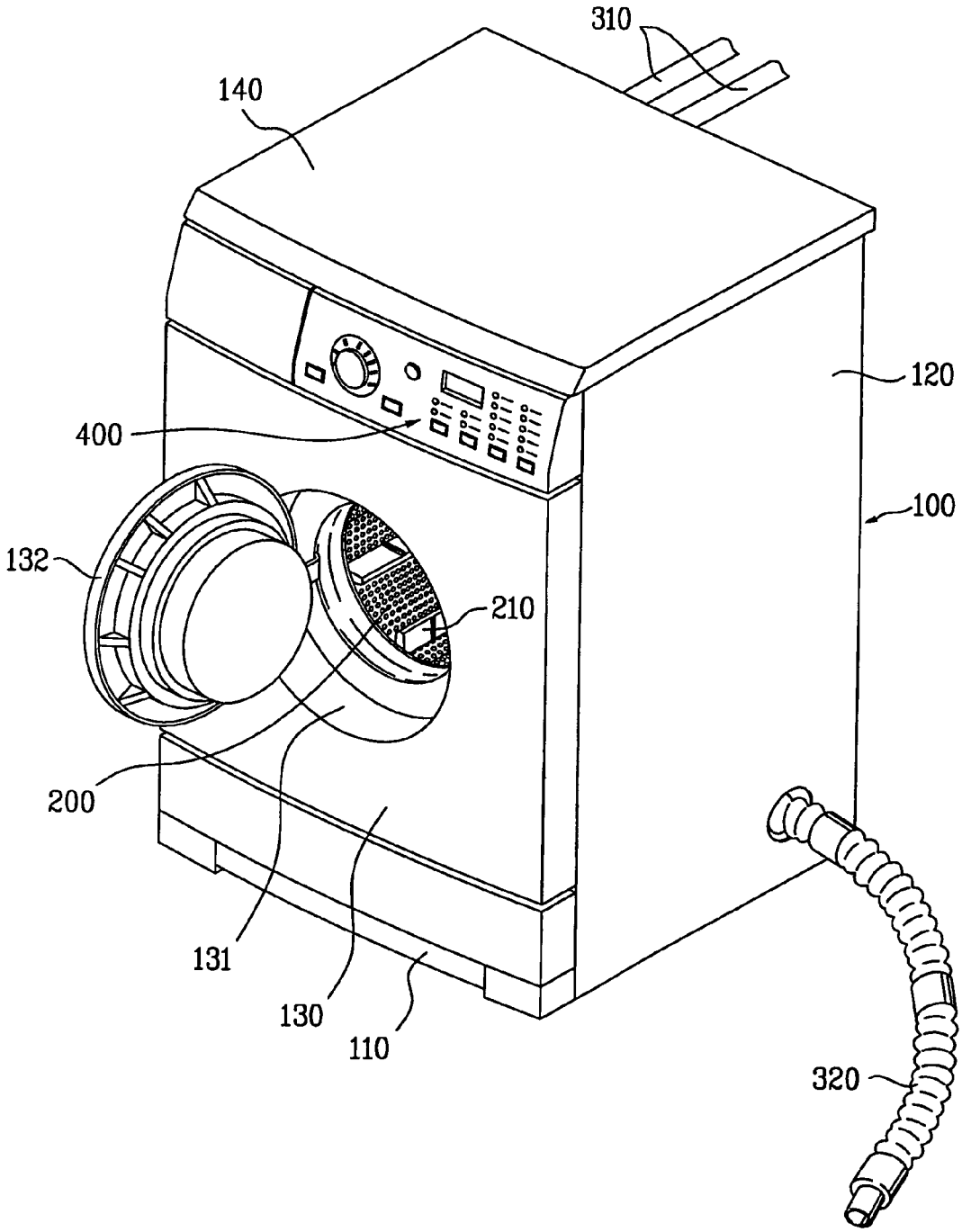
FIG. 2 is a perspective diagram of a washing machine including a button assembly according to the present invention.
Figure 3:
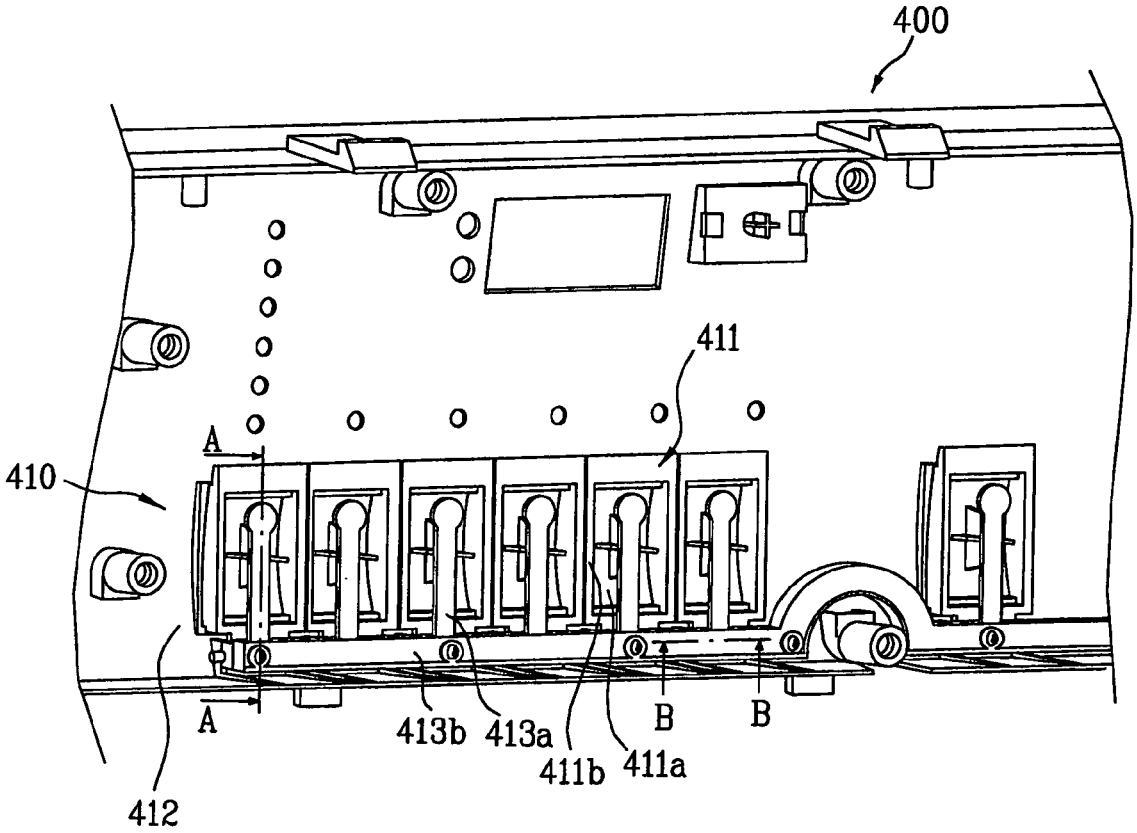
FIG. 3 is a perspective diagram of a button assembly loaded on a backside of a control panel according to the present invention.
Figure 4:
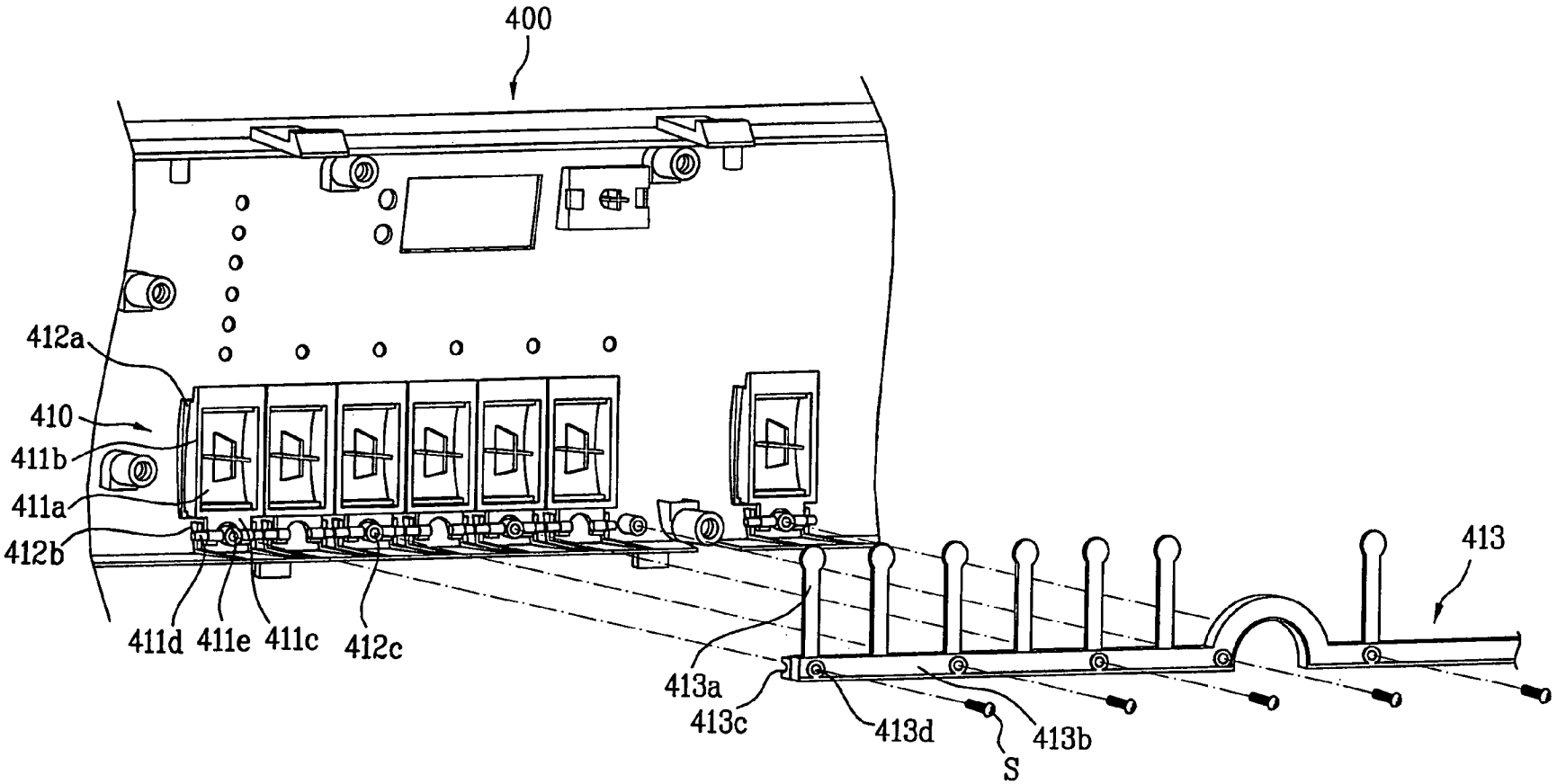
FIG. 4 is a projected perspective diagram of a button assembly including plate springs according to the present invention.
Figure 5:
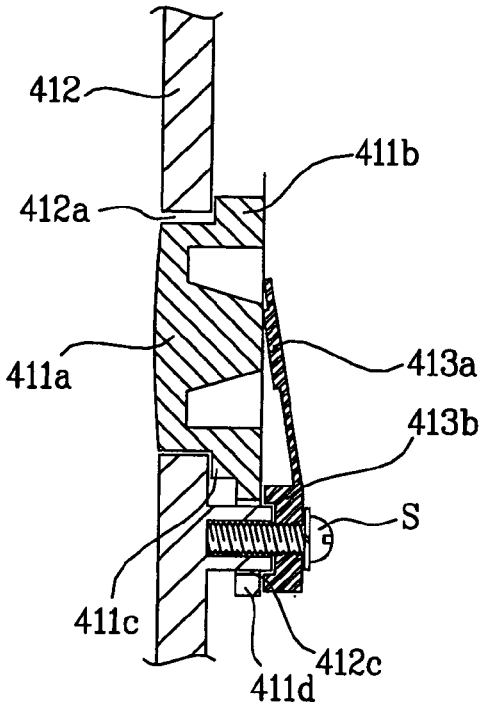
FIG. 5 is a cross-sectional diagram of a button assembly taken along line A-A of FIG. 3.
Figure 6:
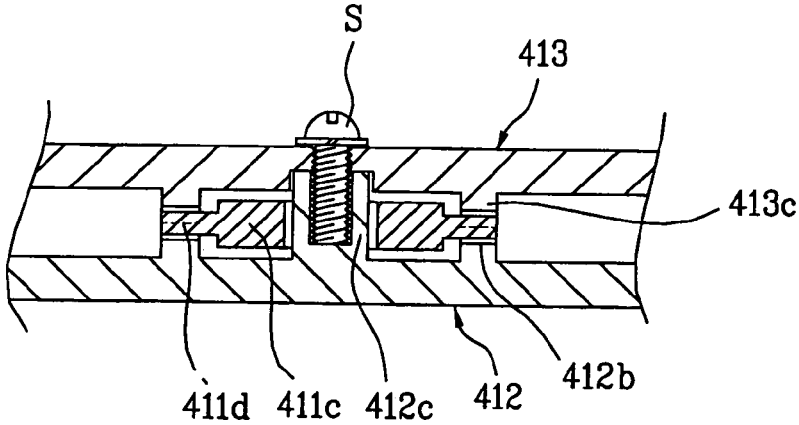
FIG. 6 is a cross-sectional diagram of a button assembly taken along line B-B of FIG. 3.

FIG. 2 is a perspective diagram of a washing machine including a button assembly according to the present invention. FIG. 3 is a perspective diagram of a button assembly loaded on a rear side of a control panel according to the present invention. FIG. 4 is a projected perspective diagram of a button assembly including plate springs according to the present invention. FIG. 5 is a cross-sectional diagram of a button assembly taken along line A-A of FIG. 3. And, FIG. 6 is a cross-sectional diagram of a button assembly taken along line B-B of FIG. 3.

Referring to FIGS. 2 and 3, a drum type washing according to one embodiment of the present invention includes a cabinet 100 forming an exterior, a tub (not shown) provided within the cabinet 100, a drum 200 rotatably provided within the tub, and a rotating means (not shown) for rotating the drum 200. The cabinet 100 includes a base plate 110 provided to a bottom side, a pair of side plates 120 provided to both sides of the base plate 110, respectively, a rear plate (not shown) provided to rear sides of the base plate 110 and side plates 120, a front plate 130 provided to front sides of the base plate 110 and side plates 120, and a top plate 140 provided to topsides of the rear plate, side plates 120, and front plate 130.

An opening 131 is formed at a center of the front plate 130 so that a laundry is put/pulled in/out via the opening 131. And, a door 132 for preventing the laundry from being separated from the opening 131 is provided to open/close the opening 131. Moreover, a control panel 400 for controlling an operation of the drum type washing machine is installed on an upper part of the front plate 130. The tub (not shown) is supported by an elastic means (not shown) such as a spring and a damper (not shown) to attenuate vibration generated from operation of the drum type washing machine. And, an entrance (not shown) is formed at a front end of the tub to confront the opening 131 of the cabinet 100.

The drum 200 has a cylindrical shape, and a multitude of perforated holes are formed thereon to let water pass through. At least one or more lifters 210 are provided to an inner wall of the drum 200 to lift a laundry up to a predetermined height. Once the drum 200 is rotated, the laundry contained within the drum 200 is repeatedly lifted upward to fall by gravity to perform washing.

A circular entrance (not shown) confronting the entrance of the tub is formed at a front end of the drum 200. Hence, the circular entrance of the drum 200, the entrance of the tub, and the opening 131 of the cabinet 100 construct a laundry entrance/exit part via which the laundry goes in or comes out of the drum 200. The rotating means can include an induction motor or BLDC motor provided in rear of the tub. A rotational shaft of the motor is connected to a rear end center of the drum 200 to perform forward or reverse rotation of the drum 200.

An inlet pipe 310 for supplying water to the tub provided within the cabinet 100 is passed through the rear plate of the cabinet 100, and a drainpipe 320 guiding the water to be discharged outside the cabinet 100 is passed through the side plate 120 of the cabinet 100. Meanwhile, a button assembly 410 for inputting an operational condition of the washing machine and a display unit (not shown) displaying an operational state of the washing machine are provided to the control panel 400.

Although not shown in the drawing, a plurality of push switches pressed by the button assembly 410, a plurality of light-emitting diodes, an integrated circuit, and a circuit board having segments and the like mounted thereon are provided inside a control panel 400.

The button assembly 410 according to the present invention is explained in detail by referring to FIGS. 3 to 6 as follows.

First of all, the button assembly 410 includes at least one or more push buttons 411 pushing the push switches, respectively, by user's push behavior for an operational condition input of the washing machine, a panel 412 having the push buttons 411 provided thereto, and an elastic part 413 elastically supporting the respective push buttons 411.

A button hole 412*a* perforating the panel 412 is formed in the panel 412 so that a portion of the corresponding push button 411 is inserted in the button hole 412*a*. The corresponding push button 411 is inserted in the button hole 412*a* from a rear side of the panel 412 and is then securely loaded therein not to be separated toward a front side of the panel 412. And, the elastic part 413 is fixed to a rear side of the panel 412 to elastically support rear sides of the respective push buttons 411.

Specifically, the push button 411 is fitted in the corresponding button hole 412*a* formed in the panel 412 to be movable in front-to-rear directions. Namely, if a user presses the push button 411, the pressed push button 411 is moved in a push direction to press the corresponding push switch. Once a user's push force is released, the push button 411 is moved in a direction opposite to the push direction by the elastic part 413 to return to its original position. Moreover, each of the push buttons 411 is assembled between the panel 412 and the elastic part 413 to be rotatable in a rear direction centering on its one end in case of being pressed by the user.

For this, the push button 411 includes a button body 411*a* inserted in the corresponding button hole 412*a* of the panel 412, a square flange 411*b* provided to a rear end rim of the button body 411*a* to prevent the push button 411 from being separated in a front direction of the panel 412 by being caught on a rear rim of the button hole 412*a* when the push button 411 returns to its original position, and a hinge shaft 411*d* protruding from a lower end of the flange 411*b* in both lateral directions to be a rotational center of the push button 411.

In this case, a lower part of the flange 411*b* includes a hinge coupling part 411*c* having the hinge shaft 411*d* coupled thereto. And, the hinge shaft 411*d* is extended longer than the flange 411*b*. Specifically, the hinge shaft 411*d* is extended in both lateral directions of the hinge coupling part 411*c* to have a shape that both its end portions are separated from each other. Of course, it is apparent that the hinge shaft 41 id may include a one-body type hinge shaft (not shown) provided to a lower end of the hinge coupling part 411*c* as well.

Meanwhile, the flange 411*b* also plays a role in shielding to prevent the parts provided within the control panel 400 from being seen via the button hole 412*a* of the panel 412 from the viewpoint of a front of the control panel 400. And, the button body 411*a* of the push button 411 is formed a little bit smaller than the button hole 412*a* in order not to be interrupted by the button hole 412*a* when the push button 411 is rotated in a rear direction of the panel 412 centering on the hinge shaft 411*d*. Moreover, the button body 411*a* is preferable thicker than the button hole 412*a* to protrude higher than a front surface of the panel 412 at a predetermined height while an external force is applied to the corresponding push button 411.

Besides, the button holes 412*a* of the panel 412 are provided in parallel to each other to have shapes corresponding to those of the push buttons 411, respectively. As the push buttons 411 of the present invention are square, the button holes 412*a* are preferably formed square, respectively. Yet, the present invention does not put limitation on the shapes or arrangement of the push buttons 411 and button holes 412*a* as explained in the description.

In a rear side of the panel 412, and more specifically, in the panel 412, a first hinge recess 412*b* having a semicircular cross-section is provided under each lower side of the button holes 412*a*. Hence, when the push button 411 is inserted in the button hole 412*a*, the hinge shaft 411*d* is rotatably loaded on the first hinge recess 412*b*. Preferably, the first hinge recess 412*b* has a shape having its both side parts separated from each other to correspond to the shape of the hinge shaft 411*d*.

Meanwhile, the elastic part 413 includes a plurality of plate springs 413*a* elastically supporting back sides of the push buttons 411, respectively, and a spring fixing part 413*b* built in one body to have the plate springs 413*a* fixed thereto vertically. In the present invention, the buttons holes 412*a* are arranged in one line so that the push buttons 411 are arranged in a row as well. Hence, it is preferable that the spring fixing part 413*b*, as shown in FIGS. 3 and 4, is built in one body. Yet, the present invention does not put limitation on the shape of the spring fixing part 413*b*. Instead, the spring fixing part 413*b* can be individually provided to each of the plate springs 413*a*. In this case, a second hinge recess 413*c* having a semicircular cross-section is formed on a front side of the spring fixing part 413*b* to enclose a rear side of the hinge shaft 411*d* of the push button 411 when the elastic part 413 is coupled to the panel 412. Preferably, the second hinge recess 413*c* has a shape having its both side parts separated from each other to correspond to the shape of the hinge shaft 411*d*.

Moreover, in order to couple the elastic part 413 to the panel 412, a plurality of coupling protrusions 412*c* respectively having cylindrical recesses are formed on the rear side of the panel 412. In this case, a screw thread is formed on each inner circumference of the coupling protrusions 412*c*, respectively. And, a plurality of coupling holes 413*d* is provided to the spring fixing part 413*b* to confront the corresponding coupling protrusions 412*c*, respectively. Hence, the panel 412 and the elastic part 413 are fixed to each other by screws 'S' driven from a rear side of the elastic part 413.

Each of the coupling protrusions 412*c* may be provided between the first hinge recess 412*b* and another first hinge recess formed under the button holes 412*a*. In such a case, an interval between the push buttons 411 extends to increase an overall width of the button assembly 410. Hence, in case of shortening the overall width of the button assembly 410, each of the coupling protrusions 412*c* is preferably provided between both end portions of the first hinge recess 412*b*. In such a case, a recess 411*e*, that is concave upward, is formed at a middle portion of the lower end of the hinge coupling part 411*c* having the hinge shaft 411*d* provided thereto, i.e., between both of the end portions of the hinge shaft 411*d*. Hence, when the push button 411 is assembled to the panel 412, the corresponding recess 411*e* prevents interruption of the corresponding coupling protrusion 412*c*. In doing so, the number of the coupling protrusions 412*c* fitted in the coupling holes 413*d* is decided by enabling to fix the elastic part 413 to the panel 412 and to prevent the push button 411 from being separated. Hence, it is able to alternately provide one coupling protrusion 412*c* per two button holes.

An assembly process of the button assembly 410 according to the present invention is explained as follows.

First of all, the push button 411 is inserted in the button hole 412*a* from the rear side of the panel 412. In doing so, the coupling protrusion 412*c* of the panel 412 is passed through the recess 411*e* at the hinge coupling part 411*c* of the push button 411 to protrude out of a rear side of the push button 411, the hinge shaft 411*d* at the lower end of the push button 411 is loaded on the first hinge recess 412*b* at the panel 412 without interruption, and the flange 411*b* of the push button 411 is loaded on the rear rim of the button hole 412*a* without interruption.

Subsequently, when the elastic part 413 is closely attached to the panel 412 and the push buttons 411 to fit the coupling protrusions 412*c* of the panel 412 in the coupling holes 413*d* of the elastic part 413, respectively, from the rear side of the panel 412, the plate springs 413*a* of the elastic part 413 are closely attached to the rear side of the push buttons 411, respectively. The screws 'S' are then driven to the coupling protrusions 412*c* via the coupling holes 413*d* from the rear side of the elastic part 413. Hence, the elastic part 413 is fixed to the panel 412, the plate springs 413*a* elastically support the rear sides of the push buttons 411, respectively, and a circumference of the hinge shaft 411*d* of each of the push buttons 411 is rotatably supported by both the first hinge recess 412*b* of the panel 412 and the second hinge recess 413*c* of the elastic part 413. Thus, the hinge shaft 411*d* of the push button 411 can be turned in a rear direction if a user presses the push button 411 from its front side.

Meanwhile, a power switch (not shown) turning on/off power of the washing machine and a rotary switch (not shown) for inputting an operational condition of the washing machine by a rotational operation can be further provided near the push buttons 411.

Moreover, the above-constructed button assembly can be provided to the topside of the cabinet as well as the front side of the cabinet. Namely, the control panel can be provided to an upper surface of the top plate 140.

Accordingly, the present invention provides the following advantages or effects.

First of all, the push button is inserted in the corresponding button hole of the panel without interruption from the rear side of the control panel and the elastic part including the plate springs is coupled to the panel to prevent the separation of the push buttons, whereby assembly and disassembly of the button assembly are facilitated.

Secondly, the separation prevention of the push buttons is performed by fixing the elastic part to the panel, whereby the number of steps of the assembling process is reduced to enhance productivity.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A button assembly, comprising:

a panel having at least one button hole and a first hinge recess that accepts a first portion of a hinge shaft;

at least one push button, pivotally provided about an axis of the hinge shaft coupled thereto, and inserted in the at least one button hole; and an elastic part, having a second hinge recess that accepts a second portion of the hinge shaft, wherein the elastic part comprises:

a spring fixing part coupled to the panel to rotatably support the at least one push button together with the panel and to prevent the at least one push button from being separated from the panel; and at least one plate spring, built in a single body with the spring fixing part, to elastically support a rear side of the at least one push button.

2. The button assembly of claim 1, wherein one end of the at least one push button is rotatably provided between the panel and the elastic part.

3. The button assembly of claim 2, wherein the push button comprises:

a button body inserted in the button hole;

a flange provided to a rear edge portion of the button body to limit a forward motion of the button body by being caught on a rim of the button hole; and the hinge shaft provided to one end of the flange, the hinge shaft being rotatably provided between the panel and the elastic part.

4. The button assembly of claim 3, wherein the hinge shaft is provided between and is supported by a first semicircular hinge recess provided to the panel and a second semicircular hinge recess provided to the elastic part.

5. The button assembly of claim 4, wherein the hinge shaft is comprised of two hinge shafts extended in both lateral directions of the flange such that the two hinge shafts are not connected to each other at an intermediate point along a common axis therebetween.

6. The button assembly of claim 5, wherein a coupling protrusion is protruded from a rear side of the panel, and wherein a coupling hole is provided to the elastic part to have the coupling protrusion inserted therein.

7. The button assembly of claim 6, wherein the coupling protrusion is provided between the two hinge shafts, and wherein a recess is provided to the flange such that a motion of the flange does not interrupt with the coupling protrusion.

8. The button assembly of claim 3, wherein a hinge coupling part is provided to one side of the flange to couple with the hinge shaft.

9. The button assembly of claim 1, wherein the elastic part comprises: at least one plate spring supporting a rear side of the at least one push button; and a spring fixing part coupled to the panel, wherein the at least one plate spring is rigidly fixed to the spring fixing part as a single body.

10. The button assembly of claim 9, wherein a plurality of the plate springs is fixed to the spring fixing part as a single body.

11. A washing machine, comprising:

a cabinet forming an exterior of the washing machine;

a tub provided within the cabinet to contain water therein;

a drum rotatably provided within the tub to perform laundry washing therein;

a control panel provided to one side of the cabinet; and a button assembly provided to the control panel to input operational commands of the washing machine, wherein the button assembly comprises:

a panel having at least one button hole and a first hinge recess that accepts a first portion of a hinge shaft;

at least one push button, pivotally provided abut an axis of the hinge shaft coupled thereto, and inserted in the at least one button hole in part; and an elastic part, having a second hinge recess that accepts a second portion of the hinge shaft, wherein the elastic part comprises:

a spring fixing part coupled to the panel to rotatably support the at least one push button together with the panel and to prevent the at least one push button from being separated from the panel; and at least one plate spring, built in a single body with the spring fixing part, to elastically support a rear side of the at least one push button.

12. The washing machine of claim 11, wherein the push button comprises:

a button body inserted in the button hole;

a flange provided to a rear edge portion of the button body to limit a forward motion of the button body by being caught on a rim of the button hole; and the hinge shaft provided to one end of the flange, the hinge shaft being rotatably provided between the panel and the elastic part.

13. The washing machine of claim 12, wherein the hinge shaft is comprised of two hinge shafts extended in both lateral directions of the flange such that the two hinge shafts are not connected to each other at an intermediate point along a common axis therebetween.

14. The washing machine of claim 13, wherein the hinge shaft is provided between and is supported by a first semicircular hinge recess provided to the panel and a second semicircular hinge recess provided to the elastic part.

15. The washing machine of claim 14, wherein a coupling protrusion is protruded from a rear side of the panel, and wherein a coupling hole is provided to the spring fixing part of the elastic part to have the coupling protrusion inserted therein.

16. The washing machine of claim 15, wherein the coupling protrusion is provided between the two hinge shafts, and wherein a recess is provided to the flange such that a motion of the flange does not interrupt with the coupling protrusion.

17. The washing machine of claim 15, wherein the coupling protrusion is fastened to the elastic part by one or more screws.

18. The washing machine of claim 15, wherein the flange comprises a hinge coupling part that couples with the hinge shaft.

19. The washing machine of claim 11, wherein a plurality of the plate springs is fixed to the spring fixing part as a single body.

* * * * *